US009789592B2

(12) United States Patent
Calianno

(10) Patent No.: US 9,789,592 B2
(45) Date of Patent: Oct. 17, 2017

(54) ROTARY TOOL

(71) Applicant: Steven F Calianno, Aliquippa, PA (US)

(72) Inventor: Steven F Calianno, Aliquippa, PA (US)

(73) Assignee: VCC STRUCTURES, INC., Aliquippa, PA (US)

( * ) Notice: Subject to any disclaimer, the term of this patent is extended or adjusted under 35 U.S.C. 154(b) by 470 days.

(21) Appl. No.: 14/506,245

(22) Filed: Oct. 3, 2014

(65) Prior Publication Data

US 2016/0096256 A1 Apr. 7, 2016

(51) Int. Cl.

| | |
|---|---|
| ***B25B 23/00*** | (2006.01) |
| ***B25B 13/06*** | (2006.01) |
| ***B25B 13/00*** | (2006.01) |
| ***B25B 21/00*** | (2006.01) |

(52) U.S. Cl.

CPC ..... *B25B 23/0035* (2013.01); *B25B 21/002* (2013.01); *B25B 21/004* (2013.01); *B25B 21/005* (2013.01); *B25B 23/0085* (2013.01); *B25B 13/06* (2013.01)

(58) Field of Classification Search

CPC . B25B 23/0035; B25B 21/005; B25B 21/004; B25B 13/06; B25B 21/002

USPC ..... 81/438, 124.3

See application file for complete search history.

(56) References Cited

U.S. PATENT DOCUMENTS

| | | | | |
|---|---|---|---|---|
| 1,390,071 | A | | 9/1921 | Wetzstein |
| 2,007,432 | A | | 7/1935 | Mancuso |
| 2,775,153 | A | * | 12/1956 | Parhaniemi ..... B25B 23/103 81/53.2 |
| 2,882,773 | A | | 4/1959 | Wing |
| 3,041,902 | A | | 7/1962 | Wing |
| 3,247,741 | A | | 4/1966 | Batten |
| 3,394,623 | A | | 7/1968 | Kinakin |
| 3,789,705 | A | | 2/1974 | Naslund |
| 3,889,558 | A | | 6/1975 | Duncan |

(Continued)

*Primary Examiner* — Bryan R Muller

(74) *Attorney, Agent, or Firm* — Adamsip, LLC; J. Hunter Adams; Stephen Thompson

(57) ABSTRACT

A preferred embodiment of the present invention is directed to a rotary tool and, more specifically, to a pneumatic wrench that can be used as both a standard socket wrench and as a fastening tool for setting HI-LOK-type fasteners commonly used in the aviation industry. In a preferred embodiment, the wrench comprises a handle and a rotational member connected to the handle, said rotational member configured for exerting torque about an axis of rotation in one direction only. The wrench further comprises a hole extending through the rotational member along the axis of rotation. The hole has two ends each having female threads. One end has right-hand threads and the second end has left-hand threads. The tool further comprises socket adaptors having right-hand and left-hand male threads for attaching the adaptors to the wrench. Each socket adaptor also has a through hole that aligns with the hole in the rotational member. The holes allow a hex key to be inserted through the wrench so that the wrench can be used to fasten HI-LOK fasteners. The simple design of the tool results in a wrench that is easy to use and relatively inexpensive to manufacture. A preferred embodiment of the invention further comprises a method of using the wrench.

16 Claims, 5 Drawing Sheets

(56) References Cited

U.S. PATENT DOCUMENTS

| | | | |
|---|---|---|---|
| 4,165,660 | A | 8/1979 | Behrens |
| 4,289,049 | A | 9/1981 | Rebish |
| 4,408,504 | A | 10/1983 | Dobosh |
| 4,544,312 | A | 10/1985 | Stencel |
| 4,593,583 | A | 6/1986 | Singleton |
| 4,617,844 | A | 10/1986 | Batten |
| 4,721,022 | A | 1/1988 | Batten |
| 4,733,584 | A | 3/1988 | Karge |
| 4,762,030 | A | 8/1988 | Nguyen |
| 4,781,085 | A | 11/1988 | Fox |
| 4,862,773 | A | 9/1989 | Batten |
| 5,095,779 | A | 3/1992 | Batten |
| 5,109,735 | A | 5/1992 | Hart |
| 5,305,666 | A | 4/1994 | LaTorre |
| 5,343,784 | A | 9/1994 | Neuhaus |
| 5,438,891 | A | 8/1995 | Batten |
| 5,461,947 | A | 10/1995 | Batten |
| 5,553,519 | A | 9/1996 | Pettit |
| 5,699,702 | A | 12/1997 | Myers |
| 5,778,741 | A | 7/1998 | Batten |
| 6,474,200 | B2 | 11/2002 | Lai Lee |
| 6,752,046 | B1 | 6/2004 | Lee |
| 6,935,209 | B2 | 8/2005 | Lantow |
| 6,948,406 | B1 | 9/2005 | Li |
| 7,874,232 | B2 | 1/2011 | Gauthreaux |
| 8,156,844 | B2 | 4/2012 | MacArthur |
| 8,479,613 | B2 | 7/2013 | Saito et al. |
| 2004/0177724 | A1 | 9/2004 | Pettit, Jr. |
| 2007/0107557 | A1 | 5/2007 | Pettit |
| 2011/0113932 | A1 | 5/2011 | Lambert |
| 2011/0197410 | A1 | 8/2011 | Estep |

* cited by examiner

ROTARY TOOL

FIELD OF THE INVENTION

The present invention refers generally to a rotary tool and, more specifically, to a pneumatic wrench that can be used as a standard socket wrench, a drill, and as a fastening tool for setting fasteners commonly used in the aviation industry.

BACKGROUND

Threaded fasteners commonly used in the aviation industry are typically comprised of a pin and a nut. One example is the well-known HI-LOK fastener. In this type of fastener, the pin is comprised of a shaft and two ends. One end has a head, and the other end has a flat surface having a polygonal-shaped recess. Typically, the recess is hexagonal-shaped. The end having the recess also has male threads around the outer surface of the pin shaft.

The nut has female threads that screw onto the male threads on the pin. The nut is also comprised of a frangible collar having a polygonal-shaped, and typically hexagonal-shaped, outer surface. As the nut is screwed onto the pin, the frangible collar is designed to shear off when a pre-determined amount of torque is applied to the nut, thereby leaving the nut fastened to the pin.

Therefore, in order to fasten the nut to the pin, it is necessary to have a fastening tool such as a wrench to engage the collar of the nut, as well as a key (hereinafter referred to as a "hex key") to simultaneously engage with the hexagonal recess at the end of the pin. The hex key is necessary in order to prevent the pin from rotating with the nut as the wrench rotates the nut and the attached collar.

Both the wrench and the hex key must be used simultaneously to fasten the nut to the pin. In the case of a simple open-ended wrench, the hex key can easily be used without obstructing the motion of the wrench. However, in the case of a socket wrench, the wrench itself must have a hole through which the hex key can be inserted in order to engage the recess in the pin.

Some prior art fastening tools combine the wrench and the hex key into a single tool. The prior art discloses both manual and power tools combining a wrench and a hex key. Such tools are commonly used in the aviation industry to set HI-LOK fasteners or similar types of fasteners. However, there are problems with tools disclosed in the prior art. Pneumatic HI-LOK fastening tools are complex pieces of equipment and, consequently, are extremely expensive to manufacture. Furthermore, pneumatic HI-LOK fastening tools are not easily adaptable for other uses that do not require a hex key, such as standard nut and bolt fastening applications. Additionally, currently available fastening tools do not allow the tool to be converted for use as a drill.

Accordingly, a need exists in the art for a relatively inexpensive and simple-to-use fastening tool that can be used to set HI-LOK fasteners or similar types of fasteners. Furthermore, a need exists in the art for a versatile tool that can be used for a variety of torqueing applications including, but not limited to, setting HI-LOK fasteners, as well as for standard nut and bolt fastening applications. Additionally, a need exists in the art for a versatile tool that can be converted from a fastening tool to a drilling tool with minimal effort.

SUMMARY

A preferred embodiment of the invention is directed generally to a rotary tool that can be used in a variety of torqueing applications. An additional embodiment of a version of the invention comprises a rotary tool that may be converted to a drilling tool. The tool may be power-driven, preferably pneumatic, but may be operated manually. In a preferred embodiment, the tool comprises a handle, a ratcheting head comprising a rotational member attached to the handle, and a hole extending through the rotational member along its axis of rotation. The hole has two ends, at least one of which has a threaded section. In a preferred embodiment, both ends have female threaded sections. The first end has right-hand threads, and the second end has left-hand threads.

The tool is further comprised of a variety of adaptors configured to easily attach to the rotational member by threading the adaptor into the hole in the rotational member. In a preferred embodiment, each adaptor has two ends, one end having male threads that can be threaded into the threaded ends of the hole in the rotational member. For instance, one type of adaptor comprises a socket adaptor. Another type of adaptor comprises a drill adaptor. The socket adaptor has male threads at one end for threading the socket adaptor into the rotational member. The other end of the socket adaptor is comprised of a protrusion having a generally square outer surface and a flat distal end configured such that the socket adaptor can be attached to a standard socket by inserting the protrusion into the square recess found in a standard socket. Thus, sockets of different sizes can be easily attached to the socket adaptor depending on the desired socket size. In addition, sockets can be easily changed by simply detaching one socket and attaching a new socket to the socket adaptor.

In a preferred embodiment, the tool comprises four different socket adaptors, each adaptor having the characteristics of the socket adaptor described above, but with certain variations. Two of the four socket adaptors have male threaded sections having right-hand threads, while the other two have left-hand threads. Thus, the socket adaptors having right-hand threads are compatible with the end of the hole in the rotational member having right-hand threads. Likewise, the socket adaptors having left-hand threads are compatible with the end of the hole in the rotational member having left-hand threads. A preferred embodiment further comprises a set of drill bit adaptors. As with the socket adaptors, one drill bit adaptor has a male threaded section having right-hand threads and the other drill bit adaptor has a male threaded section having left-hand threads. These drill adaptors are configured to accept currently available drill bits, including aviation drill bits.

In addition, both the right-hand and the left-hand versions of the socket adaptors are each available having different size protrusions on the ends of each socket adaptor opposite the male threads. In a preferred embodiment, one of the right-hand socket adaptors has a protrusion having a width of about ¼ inch, while the other right-hand socket adaptor has a protrusion having a width of about ⅜ inch. Likewise, in a preferred embodiment, one of the left-hand socket adaptors has a protrusion having a width of about ¼ inch, while the other left-hand socket adaptor has a protrusion having a width of about ⅜ inch. The two preferred sizes of the protrusions are designed to be compatible with common commercially available sockets. Similarly, the drill bit adaptor is designed to be compatible with common industry style threaded drill bits. It is understood that the socket adaptors, sockets, drill bit adaptors, and drill bits may comprise any width and length and that the above widths are solely examples of preferred embodiments of the invention.

In a preferred embodiment, each of the socket adaptors is further comprised of a through hole extending along the longitudinal length of the socket adaptor such that the through hole is aligned with the hole in the rotational member when the adaptor has been threaded into the hole. This configuration allows the tool to be used not only as a standard socket, but also allows the tool to be used to set HI-LOK fasteners or similar fasteners commonly used in the aviation industry. These types of aviation fasteners are comprised of a pin and a nut. The pin has a hexagonal-shaped recess at one end. At the same end as the recess, the pin has male threads for threading the nut onto the pin. As the socket attached to the tool engages with and rotates the nut, the pin is held in a stationary position relative to the rotating nut by a hex key engaged with the hexagonal recess in the pin. In order to engage with the pin, the hex key is inserted through the hole in the rotational member and the through hole in the socket adaptor. Thus, the hole extending through both the rotational member and the socket adaptor enables the tool to be used for setting HI-LOK-type fasteners.

In a preferred embodiment, the tool is a pneumatic wrench, though the wrench may also be used manually to set a fastener. In a preferred embodiment, the rotational member applies torque in only one direction. The direction in which torque is applied by the wrench is the direction that is opposite the direction of the threads on either end of the hole in the rotational member. Thus, a user of the tool can tighten a fastener into place using a socket attached to one side of the wrench. In order to loosen a fastener, the user can simply turn the wrench over and use a socket attached to the opposite side of the wrench. Because the direction of the threads on one end of the hole in the rotational member is opposite the direction of the threads on the other end, torque can always be applied in the opposite direction as the threads regardless of which side of the wrench is being used, thereby preventing the socket adaptors from becoming loose once the adaptors have been threaded into the rotational member.

This simple design of the tool eliminates the need for applying torque in both directions of rotation. The simple design also makes the tool relatively inexpensive to manufacture compared to currently available HI-LOK fastener tools that apply torque in both directions of rotation and that combine a wrench and a hex key into a single tool. Furthermore, the design allows the tool to be versatile, unlike currently available HI-LOK fastener tools, in that it can be used in a variety of torqueing applications, including aviation HI-LOK fastening applications as well as standard nut and bolt applications. Furthermore, the design allows the tool to be converted into a drill.

Accordingly, an object of the present invention is to provide a rotary fastening tool having a hole through a ratcheting head along the axis of rotation, said hole having right-hand and left-hand female threads at each end of the hole, respectively, along with socket adaptors for easily attaching commonly available sockets to the ratcheting head. Another object of the present invention is to provide a rotary fastening tool that can be used to set aviation HI-LOK-type fasteners as well as standard fastening systems such as a simple nut and bolt fastener. Another object of the present invention is to provide a rotary tool that may be converted to a drill. Furthermore, another object of the present invention is to provide a rotary tool that is simple to use and relatively inexpensive to manufacture.

DESCRIPTION OF THE DRAWINGS

These and other features, aspects, and advantages of the present invention will become better understood with regard to the following description, appended claims, and accompanying drawings where:

DETAILED DESCRIPTION

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, ingredients, steps, etc. are optionally present. For example, an article "comprising" components A, B, and C can contain only components A, B, and C, or can contain not only components A, B, and C, but also one or more other components.

Where reference is made herein to a method comprising two ore more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

Turning now to the drawings, FIGS. 1-8 illustrate preferred embodiments of the invention. A preferred embodiment of the invention is directed generally to a rotary tool and, more specifically, to a rotary tool that can be used as both a standard socket wrench and as a fastening tool for setting fasteners commonly used in the aviation industry, such as the well-known HI-LOK fasteners. Additionally, the rotary tool can be used as a standard drill. In a preferred embodiment, the rotary tool is a pneumatic wrench. However, the wrench may also be used manually. In addition, the wrench may be powered by another source of power, such as electrical or battery power, and still fall within the scope of the invention.

Figure 3:
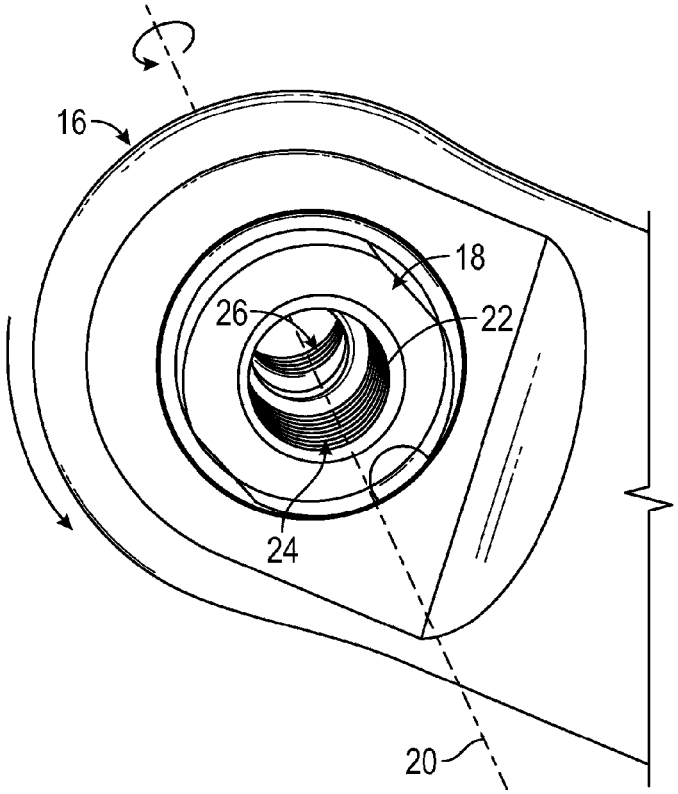
FIG. 3 is a partial view of a preferred embodiment of the invention, shown without adaptors.

The pneumatic wrench comprises a handle 10 and a lever 12 attached to the handle 10 for activating the wrench using pressurized gas. As illustrated in FIG. 3, the wrench further comprises a head 16 having a rotational member 18 configured for exerting torque in only one direction about an axis of rotation 20. The rotary member 18 ratchets in the direction opposite the direction in which torque is exerted. At the opposite end of the handle 10, there is a nozzle 14 for connecting a pressurized gas line to the tool.

Figure 1:
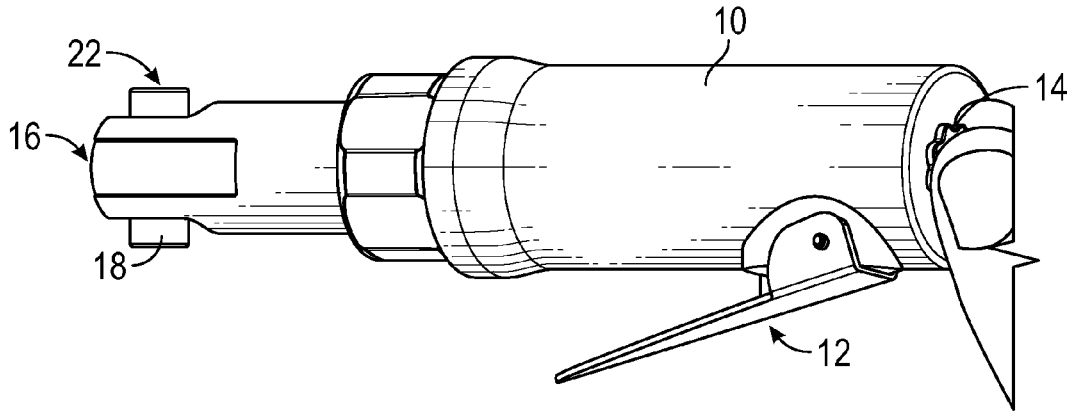
FIG. 1 is a perspective view of a preferred embodiment of the invention, shown without adaptors.
Figure 2:
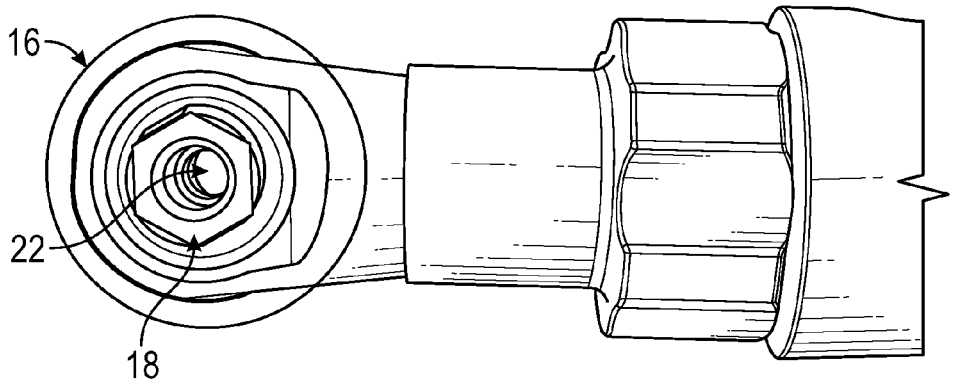
FIG. 2 is a partial view of a preferred embodiment of the invention, shown without adaptors.

As illustrated in FIG. 2 an embodiment of a version of the invention comprises the rotational member 18 having a plurality of flat sides. In a preferred embodiment the rotational member 18 is in a hex shape with six sides. It other embodiments the rotational member 18 may have more or less than six sides. Furthermore, as shown in FIG. 3, alternative embodiments of the rotational member 18 may comprise two flat sides.

The wrench further comprises a hole 22 extending through the rotational member 18 along the axis of rotation 20. The hole 22 has two ends, at least one of which has a female threaded section. In a preferred embodiment, both ends have female threads 24, 26. The first end comprises right-hand threads 24 in the hole 22 in the rotational member 18. The second end comprises left-hand 26 threads. In a preferred embodiment, as illustrated in FIG. 3, the direction of rotation is opposite the direction of the threads 24, 26 at either end of the hole 22. This feature allows one side of the head 16 to be used for tightening a fastener and the other side of the head 16 to be used for loosening a fastener. Because the rotational member 18 is configured to rotate in only one direction, a user of the tool can change the direction of rotation relative to a fastener simply by flipping the tool over and using a socket attached to the opposite side of the head 16 of the tool. This design makes the tool simpler and less expensive to manufacture by eliminating the need for having a mechanism for switching the direction of rotation.

Figure 4:
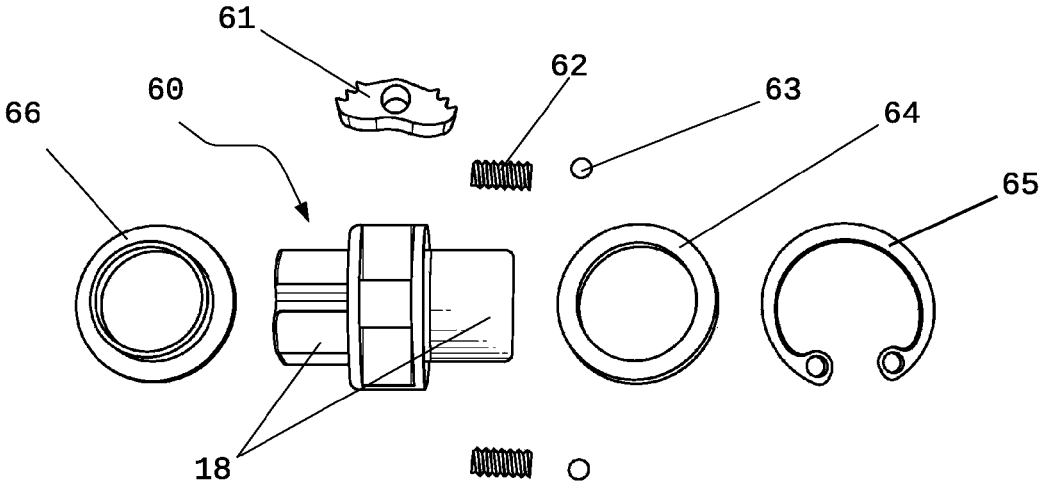
FIG. 4 depicts a preferred embodiment of the ratchet assembly of the invention.

As illustrated in FIG. 4, the tool head 16 comprises an anvil 60 configured to accept various adaptors, as described herein. The anvil 60 has a rotational member 18 on each side. As shown in FIG. 3, the anvil 60 has a through hole 20. In a preferred embodiment, the head 16 comprises an anvil 60, pawl 61, springs 62, balls 63, washer 64, retention ring 65, and plate 66.

Figure 5:
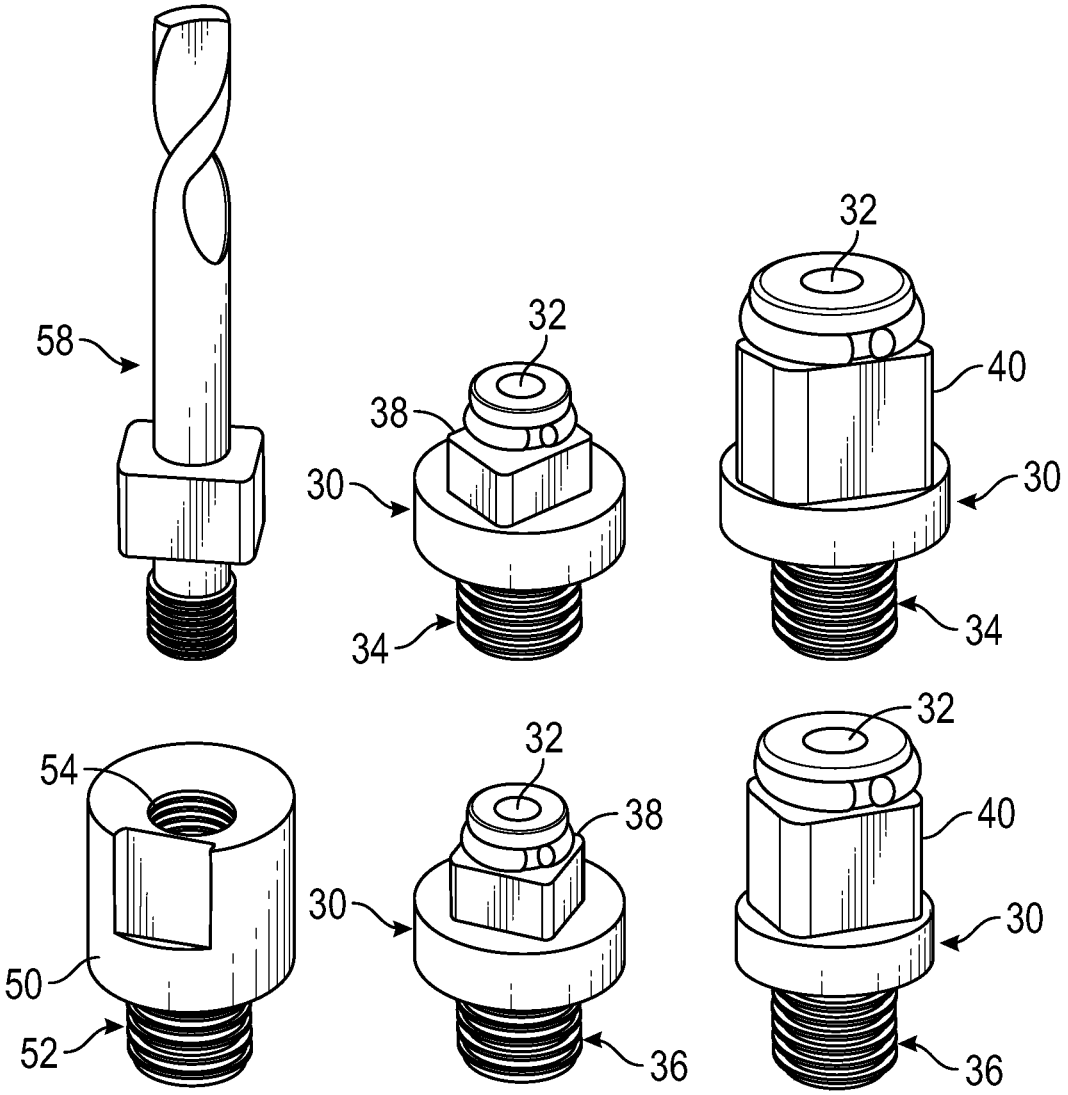
FIG. 5 shows preferred embodiments of adaptors and attachments configured for use with the present invention as depicted in FIGS. 1-3.

The tool further comprises at least one socket adaptor 30 configured for connecting the adaptor to the head 16 of the tool by threading the socket adaptor 30 into the hole 22 in the rotational member 18. In a preferred embodiment, as illustrated in FIG. 5, the tool comprises four socket adaptors 30. Each socket adaptor 30 has two ends. The first end of each socket adaptor 30 has male threads 34, 36 for threading the socket adaptor 30 into one end of the hole 22 in the rotational member 18. Two of the socket adaptors have right-hand threads 34. The other two adaptors have left-hand threads 36. Thus, the socket adaptors 30 having right-hand threads 34 are compatible with the end of the hole 22 in the rotational member 18 having right-hand threads 24. Likewise, the socket adaptors 30 having left-hand threads 36 are compatible with the end of the hole 22 in the rotational member 18 having left-hand threads 26.

As illustrated in FIG. 5, the second end of each socket adaptor 30 comprises a protrusion 38, 40 having a generally square outer surface configured such that the socket adaptor 30 can be attached to a standard socket 42 by inserting the protrusion 38, 40 into the square recess 44, 46 found in a standard socket 42. In a preferred embodiment, the tool comprises socket adaptors 30 having a protrusion 38 with a width of about ¼ inch. The tool additionally comprises socket adaptors 30 having a protrusion 40 with a width of about ⅜ inch. The two preferred sizes of the protrusions 38, 40 are designed to be compatible with common commercially available sockets 42 having a ¼ inch square recess 44 and a ⅜ inch square recess 46.

It is understood that these widths are for example only, and that any other widths may be used and still fall within the coverage of this invention. A preferred embodiment further comprises each socket adaptor 30 having retaining rings secured above the protrusion, 38, 40 for securing sockets 42.

Thus, in the most preferred embodiment of the invention, the tool comprises at least four socket adaptors 30. The first socket adaptor comprises right-hand male threads 34 at one end and a protrusion 38 with a width of about ¼ inch at the other end. The second socket adaptor comprises right-hand male threads 34 and a protrusion 40 with a width of about ⅜ inch. The third socket adaptor comprises left-hand male threads 36 and a protrusion 38 with a width of about ¼ inch. The fourth socket adaptor comprises left-hand male threads 36 and a protrusion 40 with a width of about ⅜ inch.

Figure 6:
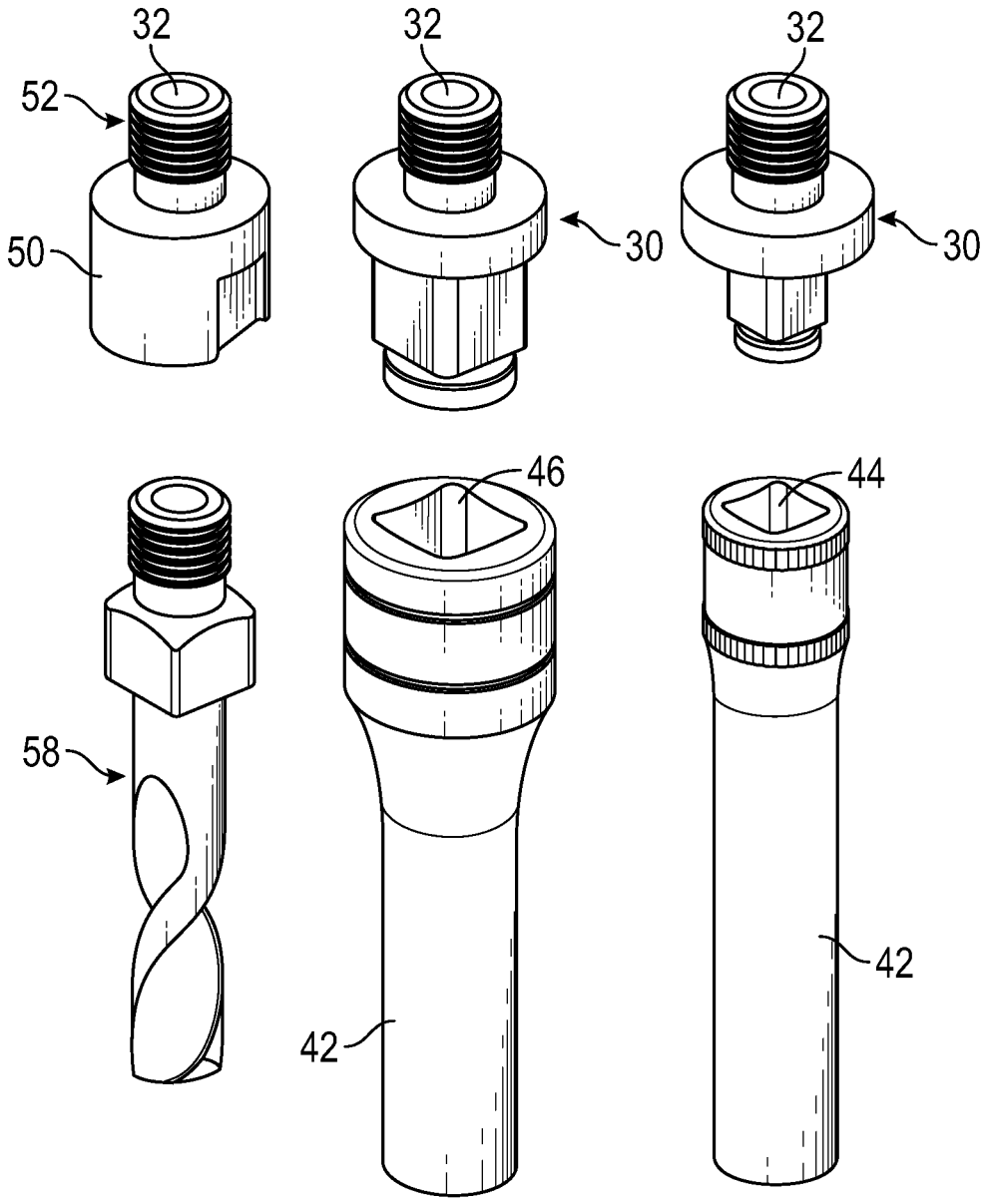
FIG. 6 shows preferred embodiments of adaptors and attachments configured for use with the present invention as depicted in FIGS. 1-3.

As illustrated in FIGS. 5-6, in a preferred embodiment of the invention, each socket adaptor 30 further comprises a through hole 32 extending along the longitudinal length of the socket adaptor 30 from the first end of the adaptor to the second end. When the socket adaptor 30 is threaded into the hole 22 in the rotational member 18, the through hole 32 in the socket adaptor 30 is aligned with the hole 22 in the rotational member 18. Thus, a hole will extend through the head 16 of the tool along the axis of rotation 20 even if socket adaptors 30 are attached to both sides of the head 16 of the tool. In addition, common commercially available sockets 42 typically have a hole extending between the square recess 44, 46 of the socket and the polygonal-shaped recess at the opposite end used to engage with a bolt, fastener, etc. Thus, when a standard socket 42 is attached to the tool via a socket adaptor 30, a hole will extend through the tool and socket combination along the axis of rotation 20.

Figure 7:
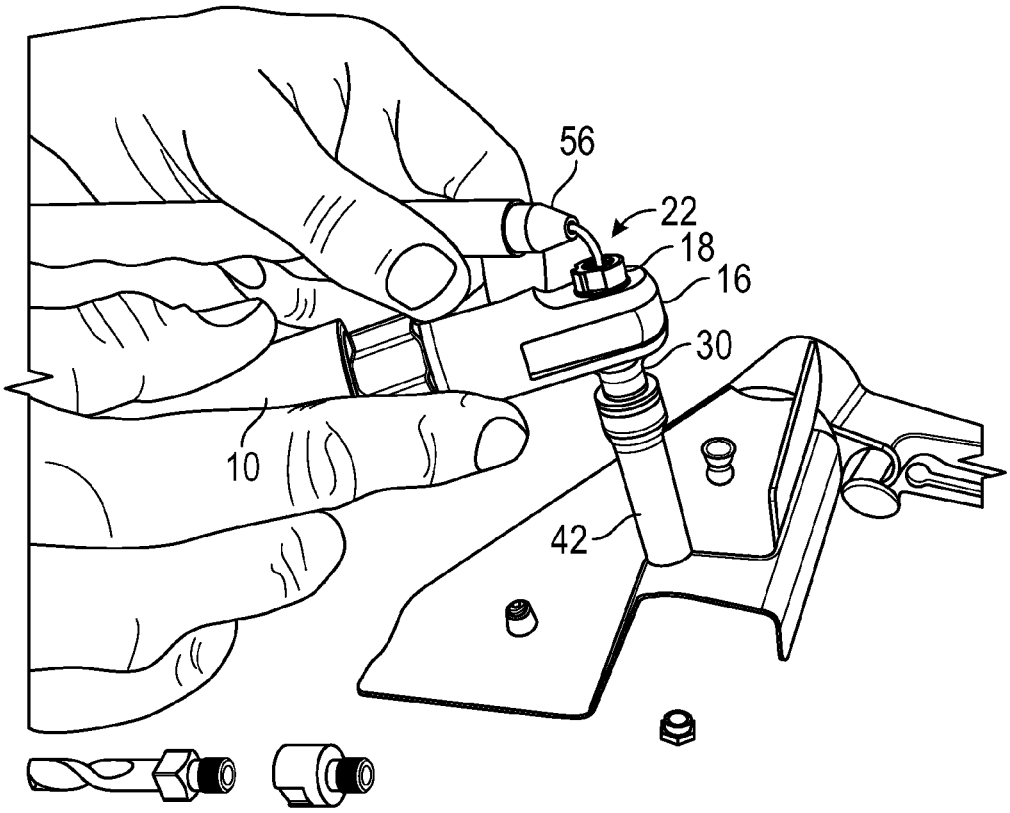
FIG. 7 shows a preferred embodiment of the invention as used with a hex key for setting a fastener.

The purpose of the through hole 32 is to allow a user of the tool to insert a hex key 56 through the hole such that the tool can be used for setting HI-LOK fasteners or similar fasteners commonly used in the aviation industry. These types of aviation fasteners are comprised of a pin and a nut. The pin has a hexagonal-shaped recess at one end. At the same end as the recess, the pin has male threads for threading the nut onto the pin. As illustrated in FIG. 7, a socket 42 is attached to the tool and engages with and rotates the nut while the pin is held in a stationary position relative to the rotating nut. The pin is held in a stationary position by the hex key 56, which is inserted through the hole 22 in the rotational member 18 and the through hole 32 in the socket adaptor 30 such that the hex key 56 is engaged with the hexagonal recess in the pin. Thus, the hole extending through both the rotational member 18 and the socket adaptor 30 enables the tool to be used for setting HI-LOK-type fasteners. However, the tool may also be used in standard nut and bolt fastening applications simply by using the tool without the hex key. Thus, the tool of the present invention is versatile in that it can be used in a variety of torqueing applications.

In a preferred embodiment, as illustrated in FIGS. 5-6, the tool further comprises a drill bit adaptor 50. The drill bit adaptor 50 has two ends. The first end has male threads 52 for threading the drill bit adaptor 50 into one end of the hole 22 in the rotational member 18. The threads 52 may be either right-hand threads or left-hand threads. The direction of the threads 52 will determine which side of the head 16 of the wrench the drill bit adaptor 50 is threaded into. The threads 52 on the drill bit adaptor 50 should preferably be threaded into the hole 22 in the rotational member 18 such that the threads 52 are in the opposite direction of the direction of rotation of the rotational member 18. This configuration will prevent the drill bit adaptor 50 from becoming loose during normal use. In a preferred embodiment, the threads 52 are right-hand threads, and the adaptor 50 is threaded into the end of the hole 22 in the rotational member 18 having right-hand threads 24.

The second end of the drill bit adaptor 50 has female threads 54 configured such that a standard drill bit 58 having male threads can be threaded into the drill bit adaptor 50. A standard drill bit 58 typically has right-hand male threads. Therefore, in a preferred embodiment, both the female threads 54 and the male threads 52 on the drill bit adaptor 50 are right-hand threads. Thus, in a preferred embodiment, the drill bit adaptor 50 is threaded into the hole 22 in the rotational member 18 having right-hand threads 24, and the direction of rotation of the rotational member 18 is in the opposite direction of both the male threads 52 and the female threads 54 on the drill bit adaptor 50, thereby preventing the drill bit 58 or the drill bit adaptor 50 from becoming loose during normal operation of the tool using a drill bit 58.

A preferred embodiment of the invention is illustrated in FIG. 3. Due to the direction of rotation indicated in FIG. 3, a socket adaptor 30 having right-hand threads 34 is used to tighten a fastener, and a socket adaptor 30 having left-hand threads 36 is used to loosen a fastener. However, it should be understood by one skilled in the art that the direction of rotation could be changed and still fall within the scope of the invention. In that case, a socket adaptor 30 having right-hand threads 34 would be used to loosen a fastener, and a socket adaptor 30 having left-hand threads 36 would be used to tighten a fastener. However, as noted above, the preferred embodiment as illustrated in FIG. 3 is the embodiment that works most effectively with commercially available drill bits 58, which typically have right-hand threads. Thus, the embodiment illustrated in FIG. 3 is the most preferred embodiment of the invention.

In an alternative embodiment of the invention, the tool comprises both sockets and drill bits having male threads (not shown) configured such that the socket or drill bit can be threaded directly into the hole 22 in the rotational member 18. In this alternative embodiment, the socket adaptors 30 and the drill bit adaptor 50 are not necessary for normal operation of the tool because the sockets and drill bits themselves can be threaded directly into the tool. However, in this embodiment, sockets and drill bits of varying sizes, all having male threads sized to fit the hole 22 in the rotational member 18, would be required to effectively utilize the tool. Thus, the most preferred embodiment comprises socket adaptors 30 and a drill bit adaptor 50 such that existing sockets and drill bits that are already commercially available can be used with the tool.

A preferred embodiment of the invention further comprises a method for setting a HI-LOK-type fastener that requires the use of a hex key, as well as a method of setting a fastener that does not require the use of a hex key. Both methods require a tool as described above, said tool having a handle 10 and a rotational member 18 attached to the handle 10 for exerting torque in one direction about an axis of rotation 20. Furthermore, the tool has a hole 22 extending through the rotational member 18 along the axis of rotation 20, at least one end of said hole 22 having female threads 24, 26. In addition, at least one socket adaptor 30 is provided, said socket adaptor having a male threaded section 34, 36 at one end and a protrusion 38, 40 configured for attaching a socket adaptor 30 to a standard socket 42 at the other end. Further, the socket adaptor 30 has a through hole 32 extending along the longitudinal length of the socket adaptor 30.

In order to set a standard fastener not requiring a hex key, the male threads 34, 36 of a socket adaptor 30 are first threaded into one end of the hole 22 of the rotational member 18. A standard socket 42 is then attached to the socket adaptor 30 by inserting the protrusion 38, 40 on the socket adaptor 30 into the square recess 44, 46 of a standard socket 42. The hexagonal-shaped recess (not shown) at the other end of the socket 42 is then engaged with a nut (not shown) having a corresponding hexagonal-shaped outer surface. The user of the tool then causes the rotational member 18 to rotate, thereby exerting torque on the nut, such that the nut is threaded onto a pin, bolt, etc. having corresponding threads compatible with the nut.

In order to set a HI-LOK-type fastener, a similar method is used except that a HI-LOK fastener assembly is utilized instead of a standard nut and bolt fastening assembly as described in the method above. In this method, the male threads 34, 36 of a socket adaptor 30 are threaded into one end of the hole 22 of the rotational member 18, and a socket 42 is attached to the socket adaptor 30 by inserting the protrusion 38, 40 on the socket adaptor 30 into the square recess 44, 46 of the socket 42. A HI-LOK-type nut (not shown) having a frangible collar is then threaded by hand onto a pin having male threads at one end and a recess configured for engagement with a hex key 56 at the same end of the pin. The hexagonal-shaped recess at the other end of the socket 42 is then engaged with the corresponding hexagonal-shaped outer surface of the frangible collar of the HI-LOK nut.

As illustrated in FIG. 7, the user of the tool then inserts the hex key 56 through the hole 22 in the rotational member 18 and the through hole 32 in the socket adaptor 30 such that the end of the hex key 56 is engaged with the recess in the pin. The user then causes the rotational member 18 to rotate, thereby exerting torque on the nut, such that the nut is threaded onto the pin. The user simultaneously holds the hex key 56 such that the hex key 56 does not rotate, thereby holding the pin in a stationary position relative to the rotating nut. The user continues exerting torque on the nut until the frangible collar shears off of the nut, thereby leaving the nut securely fastened to the pin.

Figure 8:
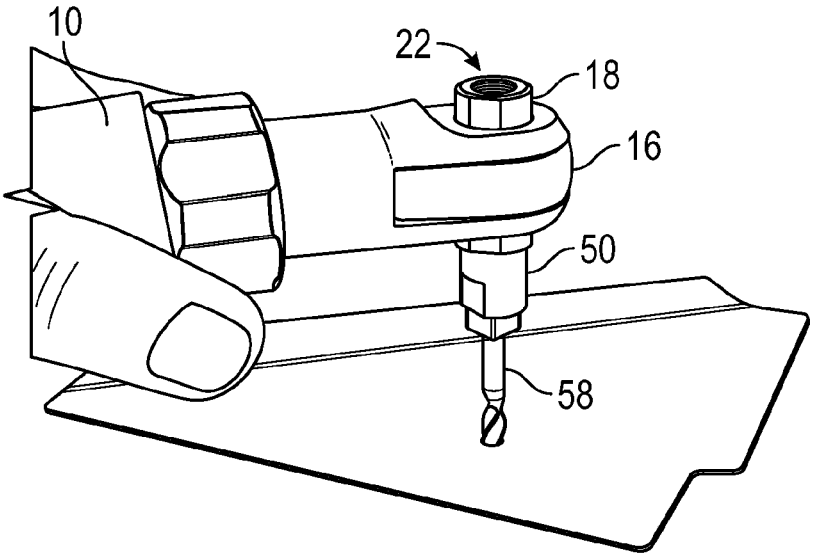
FIG. 8 shows a preferred embodiment of the invention as used as a drill.

A preferred embodiment of the invention, as illustrated in FIG. 8, further comprises a method of drilling a hole using the tool as described above. In this method, the male threads 52 of the drill bit adaptor 50 are threaded into one end of the hole 22 in the rotational member 18. An existing drill bit 58 is then threaded into the female threads 54 of the drill bit adaptor 50. The user of the tool then positions the end of the drill bit 58 against a surface where the user wants to drill a hole. Next, the user causes the rotational member 18 to rotate, thereby causing the drill bit 58 to drill a hole in the surface.

It is understood that versions of the invention may come in different forms and embodiments. Additionally, it is understood that one of skill in the art would appreciate these various forms and embodiments as falling within the scope of the invention as disclosed herein.

What I claim as my invention is:

1. A tool system comprising:

a. a handle;

b. a rotational member connected to said handle, the rotational member configured for exerting torque about an axis of rotation; and, c. a hole extending through the rotational member along the axis of rotation, said hole having two ends, the first end of said hole having a right-hand female threaded section and the second end having a left-hand female threaded section;

d. a first socket adaptor having two ends, the first end having a right-hand male threaded section for threading the socket adaptor into the right-hand female threaded section of the hole in the rotational member, the second end comprising a protrusion having a generally square outer surface configured for attaching said first socket adaptor to a standard socket;

e. a second socket adaptor having two ends, the first end having a left-hand male threaded section for threading the socket adaptor into the left-hand female threaded section of the hole in the rotational member, the second end comprising a protrusion having a generally square outer surface configured for attaching said second socket adaptor to a standard socket.

2. The tool system of claim 1, said first socket adaptor having a through hole aligned with the axis of rotation of the rotational member when the first socket adaptor is threaded into the hole in the rotational member.

3. The tool system of claim 2, said square outer surface having a width of about ¼ inch.

4. The tool system of claim 2, said square outer surface having a width of about ⅜ inch.

5. The tool system of claim 1, said second socket adaptor having a through hole aligned with the axis of rotation of the rotational member when the second socket adaptor is threaded into the hole in the rotational member.

6. The tool system of claim 5, said square outer surface having a width of about ¼ inch.

7. The tool system of claim 5, said square outer surface having a width of about ⅜ inch.

8. The tool system of claim 1, further comprising a drill bit adaptor having two ends, the first end having a male threaded section configured for threading the drill bit adaptor into one end of the hole in the rotational member, the second end having a female threaded section configured for attaching said second end to a standard drill bit having male threads.

9. The tool system of claim 1, the tool further comprising an external power source for exerting torque about the axis of rotation.

10. The tool system of claim 9, said external power source comprising a pneumatic power source.

11. A pneumatic power wrench comprising:

a. a handle;

b. a rotational member connected to said handle, the rotational member configured for exerting torque about an axis of rotation;

c. a hole extending through the rotational member along the axis of rotation, said hole having two ends, each end having a female threaded section, the first end having right-hand threads and the second end having left-hand threads; and, d. two socket adaptors each having two ends, the first end of the first socket adaptor having right-hand male threads and the first end of the second socket adaptor having left-hand male threads, the second end of each socket adaptor comprising a protrusion having a generally square outer surface configured for attaching each said second end to a standard socket, each of the two socket adaptors further comprising a through hole aligned with the axis of rotation of the rotational member when each socket adaptor is threaded into one end of the hole in the rotational member.

12. The tool system of claim 11, said square outer surface of each second end of each socket adaptor having a width of about ¼ inch.

13. The tool system of claim 11, said square outer surface of each second end of each socket adaptor having a width of about ⅜ inch.

14. The tool system of claim 11, further comprising a drill bit adaptor having two ends, the first end having a male threaded section configured for threading the drill bit adaptor into one end of the hole in the rotational member, the second end having a female threaded section configured for attaching said second end to a standard drill bit having male threads.

15. A method of setting a threaded fastener, said method comprising the steps of:

a. providing a tool system, said tool comprising:

i. a handle;

ii. a rotational member connected to said handle, the rotational member configured for exerting torque about an axis of rotation;

iii. a hole extending through the rotational member along the axis of rotation, said hole having two ends, the first end of said hole having a right-hand female threaded section and the second end having a left-hand female threaded section;

iv. two socket adaptors each having two ends, the first end of the first socket adaptor having right-hand male threads and the first end of the second socket adaptor having left-hand male threads, the second end of each socket adaptor comprising a protrusion having a generally square outer surface configured for attaching each said second end to a standard socket, each of the two socket adaptors further comprising a through hole aligned with the axis of rotation of the rotational member when each socket adaptor is threaded into the hole in the rotational member;

b. providing an existing fastener assembly, said assembly comprising a pin having male threads at one end and a nut having female threads compatible with the male threads on the pin, said nut having a polygonal-shaped outer surface compatible with a standard socket;

c. providing an existing standard socket having two ends, the first end having a generally square recess compatible with the square protrusion on the socket adaptor, the second end having a polygonal-shaped recess of a desired size for engagement with the nut of the existing fastener assembly;

d. threading the male threads of the socket adaptor into the female threads in the hole in the rotational member;

e. attaching the existing socket to the socket adaptor by inserting the square protrusion on the socket adaptor into the square recess in the socket;

f. engaging the polygonal-shaped recess in the existing socket with the polygonal-shaped outer surface of the nut; and, g. causing the rotational member to rotate such that the nut is threaded onto the pin.

16. A method of setting a threaded fastener, said method comprising the steps of:

a. providing a tool system, said tool comprising:

i. a handle;

ii. a rotational member connected to said handle, the rotational member configured for exerting torque about an axis of rotation;

iii. a hole extending through the rotational member along the axis of rotation, said hole having two ends, the first end of said hole having a right-hand female threaded section and the second end having a left-hand female threaded section;

iv. two socket adaptors each having two ends, the first end of the first socket adaptor having right-hand male threads and the first end of the second socket adaptor having left-hand male threads, the second end of each socket adaptor comprising a protrusion having a generally square outer surface configured for attaching each said second end to a standard socket, each of the two socket adaptors further comprising a through hole aligned with the axis of rotation of the rotational member when each socket adaptor is threaded into the hole in the rotational member;

b. providing an existing standard hex key, said hex key having a diameter smaller than both the hole in the rotational member and the through hole in the socket adaptor;

c. providing an existing fastener assembly, said assembly comprising a pin having male threads at one end and a recess configured for engagement with the hex key at the same end, said assembly further comprising a nut having female threads compatible with the male threads on the pin and a frangible collar having a polygonal-shaped outer surface compatible with a standard socket;

d. providing an existing standard socket having two ends, the first end having a generally square recess compatible with the square protrusion of the socket adaptor, the second end having a polygonal-shaped recess of a desired size for engagement with the frangible collar of the existing fastener assembly, said socket further comprising a through hole extending between the two ends of the socket;

e. threading the male threads of the socket adaptor into the female threads in the hole of the rotational member;

f. attaching the existing socket to the socket adaptor by inserting the square protrusion on the socket adaptor into the square recess in the socket;

g. inserting the existing hex key through the hole in the rotational member, the through hole in the socket adaptor, and the through hole in the socket, such that the hex key engages with the recess in the pin;

h. engaging the polygonal-shaped recess in the existing socket with the polygonal-shaped outer surface of the frangible collar;

i. causing the rotational member to rotate such that the nut is threaded onto the pin while simultaneously holding the hex key in a substantially stationary position such that the pin remains substantially stationary relative to the nut; and, j. continuing to thread the nut onto the pin until a pre-determined level of torque is achieved, thereby shearing the frangible collar off of the nut.

* * * * *